US006042434A

United States Patent [19]

Nakamura

[11] Patent Number: 6,042,434

[45] Date of Patent: Mar. 28, 2000

[54] HYDRAULIC TILT AND TRIM UNIT FOR MARINE DRIVE

[75] Inventor: Daisuke Nakamura, Hamamatsu, Japan

[73] Assignee: Sanshin Kogyo Kabushiki Kaisha, Japan

[21] Appl. No.: 08/999,210

[22] Filed: Dec. 29, 1997

[30] Foreign Application Priority Data

Dec. 26, 1996 [JP] Japan ..... 8-357211

[51] Int. Cl.[7] ..... B63H 5/125

[52] U.S. Cl. ..... 440/61

[58] Field of Search ..... 440/61, 62, 65, 440/53

[56] References Cited

U.S. PATENT DOCUMENTS

| | | | |
|---|---|---|---|
| 4,521,202 | 6/1985 | Nakahama | 440/61 |
| 4,545,769 | 10/1985 | Nakahama et al. | 440/61 |
| 4,551,104 | 11/1985 | Iwashita et al. | 440/61 |
| 4,557,696 | 12/1985 | Nakahama . | |
| 4,631,035 | 12/1986 | Nakahama . | |
| 4,695,260 | 9/1987 | Suzuki et al. . | |
| 4,702,714 | 10/1987 | Nakase . | |
| 4,909,766 | 3/1990 | Taguchi . | |
| 4,990,111 | 2/1991 | Saitoh et al. . | |
| 5,007,866 | 4/1991 | Okita . | |
| 5,049,099 | 9/1991 | Ito et al. . | |
| 5,149,286 | 9/1992 | Tsujii . | |

*Primary Examiner*—Stephen Avila
*Attorney, Agent, or Firm*—Knobbe, Martens, Olson & Bear, LLP

[57] ABSTRACT

An improved hydraulic circuit for a tilt and trim adjustment system allows an associated marine drive to be trimmed up into a tilt range for running in shallow water. The circuit includes a tilt relief valve. The valve differentiates between the hydraulic pressures within the system caused by various running conditions, and opens the valve only when two conditions are met: (i) the associated pump is activated and (ii) high pressure exists at the valve's inlet side, which usually occurs when running at high speeds. The valve, however, remains closed at slower speeds. The marine drive thus can be raised up and operated within the tilt range, provided that the speed is slow enough.

17 Claims, 9 Drawing Sheets

HYDRAULIC TILT AND TRIM UNIT FOR MARINE DRIVE

BACKGROUND OF THE INVENTION

1. Field of the Invention

This invention relates to a marine propulsion unit for a watercraft, and more particularly to a hydraulic tilt and trim adjustment system for a marine propulsion unit.

2. Description of Related Art

The optimal trim angle of an outboard motor varies with a watercraft's running condition. For instance, the bow of the watercraft should press against the water when accelerating from rest or from a slow speed. To achieve this condition, the angle of the propeller shaft is disposed at a negative angle relative to the horizontal (i.e., at a negative trim angle). A thrust vector produced by the propeller in this position is thus out of the water. When running at high speed, the propeller is raised or trimmed to position the propeller shaft at a positive trim angle relative to the horizontal within the range of about 0° to 15°. The outboard motor also must be raised beyond the normal trim range in order to operate in shallow water and for storage in a fill tilt-up position A hydraulic tilt and trim adjustment system often supports an outboard motor on a watercraft, and adjusts the trim and tilt position of the outboard motor. The tilt and trim adjustment system usually includes at least one hydraulic actuator which operates between a clamping bracket and a swivel bracket. The clamping bracket is attached to the watercraft and the swivel bracket supports the outboard motor. A pivot pin connects the swivel and clamping brackets together. The actuator causes the swivel bracket to pivot about the axis of the pivot pin relative to the stationary clamping bracket to raise or lower the outboard drive.

Tilt and trim adjustment systems also usually employ a hydraulic motor that affects the trim and tilt operations of the outboard drive. For this purpose, prior hydraulic motors have included a reversible electric motor that selectively drives a reversible fluid pump. The pump pressurizes or depressurizes the hydraulic actuator for raising or lowering the outboard drive.

In particular, the fluid pump supplies pressurized fluid to various ports of the actuator's closed cylinder, on either side of a piston which slides within the cylinder. The piston forms separate chambers within the cylinder. A conventional seal, such as one or more O-rings, operates between the piston and cylinder bore to prevent flow from between the chambers. The piston moves within the cylinder by pressurizing the chamber on one side of the piston and depressuring the other chamber on the opposite side.

An actuator arm is attached to the piston and to the swivel bracket. The other end of the cylinder is attached to the clamping bracket. By pressurizing and depressurizing the chambers within the actuator, the piston and thus the outboard motor can be moved.

The pressures in the cylinder chambers vary greatly depending on whether the propulsion unit is operating in a trim range or in a tilt range. In a tilt range, usually associated with tilting the propulsion unit out of the water, the pump generates a relatively low pressure in the chambers because the only load on the cylinder is the weight of the propulsion unit.

The pump conversely must generate far greater pressure to trim-up the motor because of the load placed on the unit by the propulsion unit. The increase in load results from the thrust of the propulsion unit. That is, a portion of the thrust produced by the propulsion unit acts downward and against the tilt and trim mechanism when trimming up. Higher pressures therefore are required in the cylinder to trim up the motor when running at high speeds (e.g., planning speeds).

Prior tilt and trim mechanism have included a relief valve to prevent too much pressure from building within the cylinder. Not only can such pressure damage internal seals, fittings and components of the tilt and trim mechanism, it also can cause the outboard motor to "pop-up" quickly.

Undesirable motor pop-up occurs because the thrust of the propulsion system sudden decreases as the motor is swung through the tilt range. Within the tilt range, the large pressure built-up within the cylinder rapidly pushes the piston upward and causes the outboard motor to pop-up quickly. By properly setting the relief valve, this phenomenon tends not to occur.

Prior tilt and trim adjustment mechanisms have selected the relief valve to open at a pressure just above that associated with running the outboard motor at full throttle and under a fully trimmed-up condition. For larger outboard motors (e.g., 200 hp) this valve design works well. At medium and low speeds, the outboard motor can be trimmed up into the tilt range to accommodate running in shallow waters. (The pop-up phenomenon tends not occur at these speeds because the pressure within the cylinder required to trim up the motor is much less than that when running at high speeds.) The relief valve remains closed under these running conditions.

SUMMARY OF THE INVENTION

The present invention involves the recognition that this prior type of hydraulic circuit design does not work as well with smaller sized outboard motors (e.g., 90 hp). The thrusts produced by smaller outboard motors at a medium speed and at full throttle are generally the same, at least in the extent of the conventional relief valve's accuracy. The relief valve consequently opens and prevents trimming up the outboard motor in the tilt range when running at medium speeds. This of course poses a problem when the watercraft operator desires to run the watercraft in shallow water. (This observation is discussed in more detail below in connection with FIG. 9.)

A need therefore exists for an improved hydraulic circuit for use with at least smaller outboard motors which permits the outboard motor to be trimmed up into the tilt range when ruling at low or medium speeds, but not at high speeds.

One aspect of the present invention thus involves a hydraulic tilt and trim adjustment system for a marine drive. The tilt and trim system comprises an actuator that has a stroke length. A portion of the stroke length corresponds to a trim range of the marine drive and the balance of the stroke length corresponds to a tilt range. A pump selectively supplies a working fluid to a chamber of the actuator. A reservoir tank communicates with the pump, and a passage extends between the cylinder chamber and the reservoir tank. A tilt pressure relief valve is positioned within the passage. The valve is configured within the system to be open when the pump is active, and closed when the pump is inactive so as to maintain the tilt position of the marine drive at least at low and medium speeds.

Another aspect of the present invention involves a hydraulic tilt and trim adjustment system for a marine drive. The tilt and trim system comprises an actuator having at least one fluid chamber, and a relief port communicating with the chamber. A pump selectively supplies working fluid to the chamber. A relief valve is connected to the relief port to selectively permit fluid flow through the relief port. The valve is linked to the pump so as to be opened only when the pump is activated.

A preferred method of operating a hydraulic tilt and trim adjustment system involves maintaining closure of a tilt relief valve when the marine drive is operating at low and medium speeds and the actuator is within a tilt stroke range. The tilt relief valve is only opened when a pre-selected pressure is applied to an inlet of the tilt relief valve and the associated pump is activated. The pre-selected pressure desirably corresponds to the pressure produced within an actuator of the tilt and trim system when operating under high speed conditions.

Further aspects, features, and advantages of the present invention will become apparent from the detailed description of the preferred embodiments which follows.

BRIEF DESCRIPTION OF THE DRAWINGS

The above-mentioned and other features of the invention will now be described with reference to the drawings of a preferred embodiment of the present tilt and trim adjustment system. The illustrated embodiment is intended to illustrate, but not to limit the invention. The drawings contain the following figures.

FIG. 1 also schematically illustrates, in phantom lines, a partial lower section of the outboard motor in a fully trimmed-up position (TU) and a full tilt-up position (FU).

DETAILED DESCRIPTION OF THE PREFERRED EMBODIMENT

Figure 1:
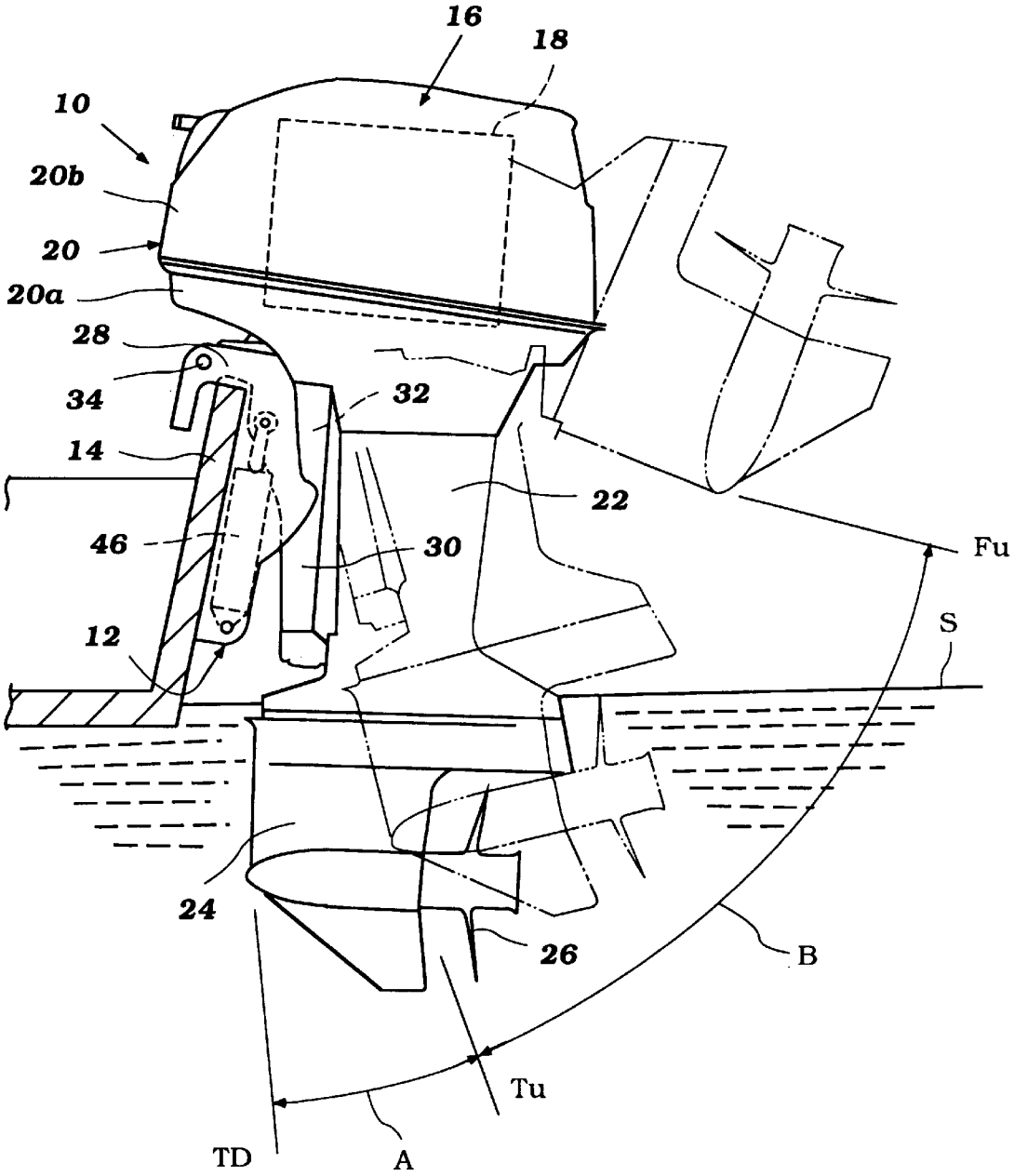
FIG. 1 is a side elevational view of an outboard motor, which includes a hydraulic tilt and trim adjustment mechanism configured in accordance with a preferred embodiment of the invention. The outboard motor is illustrated as attached to the transom of an associated watercraft in a fully trimmed-down position (TD).

FIG. 1 illustrates an exemplary outboard motor 10 which incorporates a hydraulic tilt and trim adjustment system 12 configured in accordance with the present invention. Because the present tilt and trim adjustment system has particular utility with a small outboard motor, the following describes the tilt and trim unit in connection with such an outboard motor; however, the depiction of the invention in conjunction with an outboard motor is merely exemplary. Those skilled in the art will readily appreciate that the present tilt and trim adjustment system can be readily adapted for use with other types and sizes of marine drives, such as, for example, but without limitation, a stern drive unit of an inboard/outboard drive. Accordingly, as used herein "marine drive" shall include stem drives, outboard motors and the like.

In the illustrated embodiment, the tilt and trim adjustment system 12 supports the outboard motor 10 on a transom 14 of an associated watercraft. An exemplary outboard motor is illustrated in FIG. 1, and the following will initially describe the outboard motor in order to provide the reader with an understanding of the illustrated environment of use.

The outboard motor 10 has a power head 16 which desirably includes an internal combustion engine 18. The internal combustion engine 18 can have any number of cylinders and cylinder arrangements, and can operate on a variety of known combustion principles (e.g., on a two-stroke or a four-stroke principle).

A protective cowling assembly 20 surrounds the engine 18. The cowling assembly 20 includes a lower tray 20*a* and a top cowling 20*b*. The tray 20*a* and the cowling 20*b* together define a compartment which houses the engine 18 with the lower tray 20*a* encircling a lower portion of the engine 18.

The engine 18 is mounted conventionally with its output shaft (i.e., a crankshaft) rotating about a generally vertical axis. The crankshaft drives a drive shaft, as known in the art. The drive shaft depends from the power head 16 of the outboard motor 10.

A drive shaft housing 22 extends downwardly from the lower tray and terminates in a lower unit 24. The drive shaft extends through the drive shaft housing 22 and is suitably journaled therein for rotation about the vertical axis.

The drive shaft continues into the lower unit 24 to drive a propulsion shaft through a transmission. The propulsion shaft drives a propulsion device 26 which the lower unit 24 supports.

In the illustrated embodiment, the propulsion device 26 comprises a propeller. The propulsion device, however, which can take the form of a dual, counter-rotating propeller system, a hydrodynamics jet, or like propulsion device.

A coupling assembly of the tilt and trim adjustment system 12 supports the outboard motor 10 on the watercraft transom 14 so as to position a propulsion device 26 in a submerged position with the watercraft resting on the surface S of a body of water. The coupling assembly is principally formed between a clamp bracket 28, a swivel bracket 30, a steering shaft 32, and a pivot pin 34.

The steering shaft 32 is affixed to the drive shaft housing 22 through upper and lower brackets. An elastic isolator connects each bracket, 38 to the drive shaft housing 22. The elastic isolators permit some relative movement between the drive shaft housing 22 and the steering shaft 32 and contain damping mechanisms for damping engine vibrations transmitted from the drive shaft housing 22 to the steering shaft 32.

The steering shaft 32 is rotatably journaled for steering movement about a steering axis within the swivel bracket 30. A steering actuator (not shown) is attached to an upper end of the steering shaft 32 to steer the outboard motor 10, in a know manner. Movement of the actuator rotates the steering shaft 32, as well as the drive shaft housing 22 which is connected through the upper and lower brackets about the steering axis.

The swivel bracket 30 includes a cylindrical housing through which the steering shaft 32 extends. A plurality of bearing assemblies journal the steering shaft 32 within the cylindrical housing.

The swivel bracket 30 also includes a pair of lugs which project forward toward the watercraft transom 14. Each lug includes a coupling hole at its front end. The coupling holes are aligned with each other along a common pivot axis.

As best seen in FIG. 1, the clamping bracket 28 is affixed in a conventional manner to the transom 14. The clamping bracket 28 includes a support plate. The support plate abuts the outer surface of the transom 14 when the clamping bracket 28 is attached to the watercraft.

A pair of flanges project toward the outboard motor 10 from the sides of the support plate. The flanges are spaced apart from each other by a sufficient distance to receive the swivel bracket 30 between the flanges. The flanges also shield the space between the support plate and the cylindrical housing of the swivel bracket 30 to protect the inner components of the tilt and trim adjustment system 12.

The pivot pin 34 completes the hinge coupling between the clamping bracket 28 and the swivel bracket 30. The pivot pin 34 extends through the aligned coupling holes of the clamping bracket and the swivel bracket lugs and is fixed to the clamping bracket. The inner surfaces of the coupling holes through the swivel bracket lugs act as bearing surfaces as the swivel bracket 30 rotates about the pivot pin 34. The outboard motor 10 thus can be pivoted about the pivot axis defined by the pivot pin 34, through a continuous range of trim positions. In addition, the pivotal connection permits the outboard motor 10 to be tilted up and out of the water for storage or transport, as known in the art.

The hydraulically-operated tilt and trim adjustment system 12 operates between the clamping bracket 28 and the swivel bracket 30 to effectuate the tilt and trim movement of the outboard motor 10. As a result of the pivotal connection between the clamping bracket 28 and the swivel bracket 30, the tilt and trim adjustment system can move the outboard motor 10 through a trim range A between a fully trimmed-down position (TD) and a fully trimmed-up position (IU). The tilt and trim adjustment system 12 can also move the outboard motor 10 through a tilt-up range B between the fully trimmed-up position (TU) and a full tilt-up position (FU).

The tilt and trim adjustment system 12 will now be described with additional reference to FIGS. 2 through 6. In the illustrated embodiment, the tilt and trim adjustment system 12 includes an actual hydraulic motor assembly, indicated generally by the reference numeral 36. The hydraulic motor assembly is located adjacent to a powering assembly 38 of the tilt and trim adjustment system 12. The powering assembly 38 includes a reversible electric motor 40 located at an upper end. A reversible hydraulic pump 42 is disposed below the motor 40. A fluid reservoir or sump 44 is disposed beneath the pump 42 and contains working fluid (e.g., hydraulic fluid) for the system 12. In addition a suitable valve assembly may be incorporated into the pump 42 and reservoir 44 to provide the normal pressure relief functions, as described below.

The pump 28 includes a pair of outlet ports that communicate with inlet ports formed in the hydraulic motor assembly 36. It should be noted that the outer housings of the units 36, 38 may be common or, the units may comprise separate pieces that are affixed to each other. By having interfitting ports, the necessity for providing external conduits is avoided and the construction is more compact.

Figure 2:
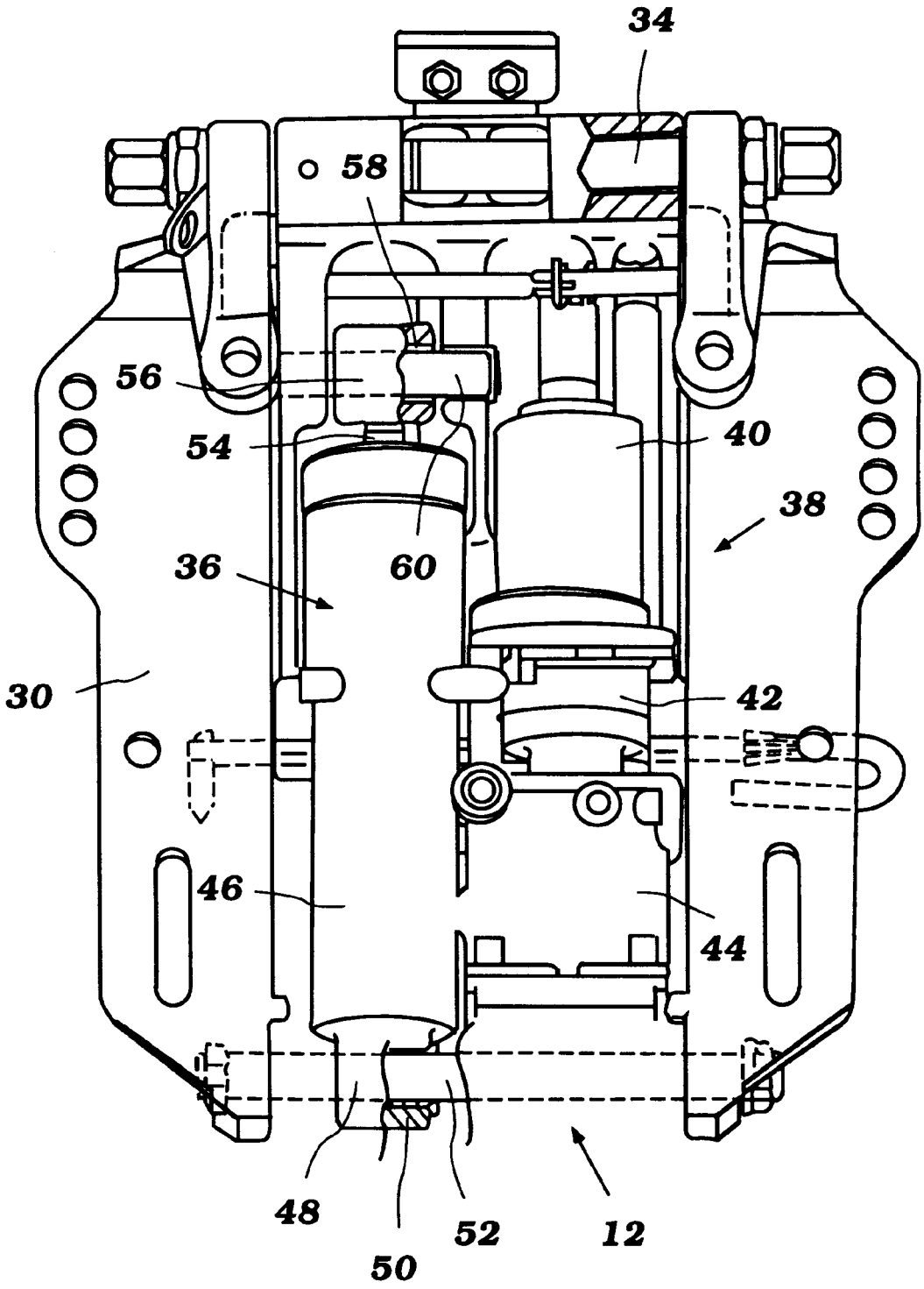
FIG. 2 is an enlarged front elevational view of the hydraulic tilt and trim adjustment system of FIG. 1.

As best seen in FIG. 2, the hydraulic motor 36 includes an actuator cylinder 46 having a tnnnion 48 with a bore 50 that receives a pin 52 to provide a pivotal connection to the clamping bracket 12, and specifically to the side plates.

An actuator arm 54, that projects beyond an upper end of the cylinder 46, also has a trunnion 56 with a bore 58. This piston rod bore 58 a pivot pin 60 that pivotally connects the actuator arm 54 to the swivel bracket 30.

Figure 3:
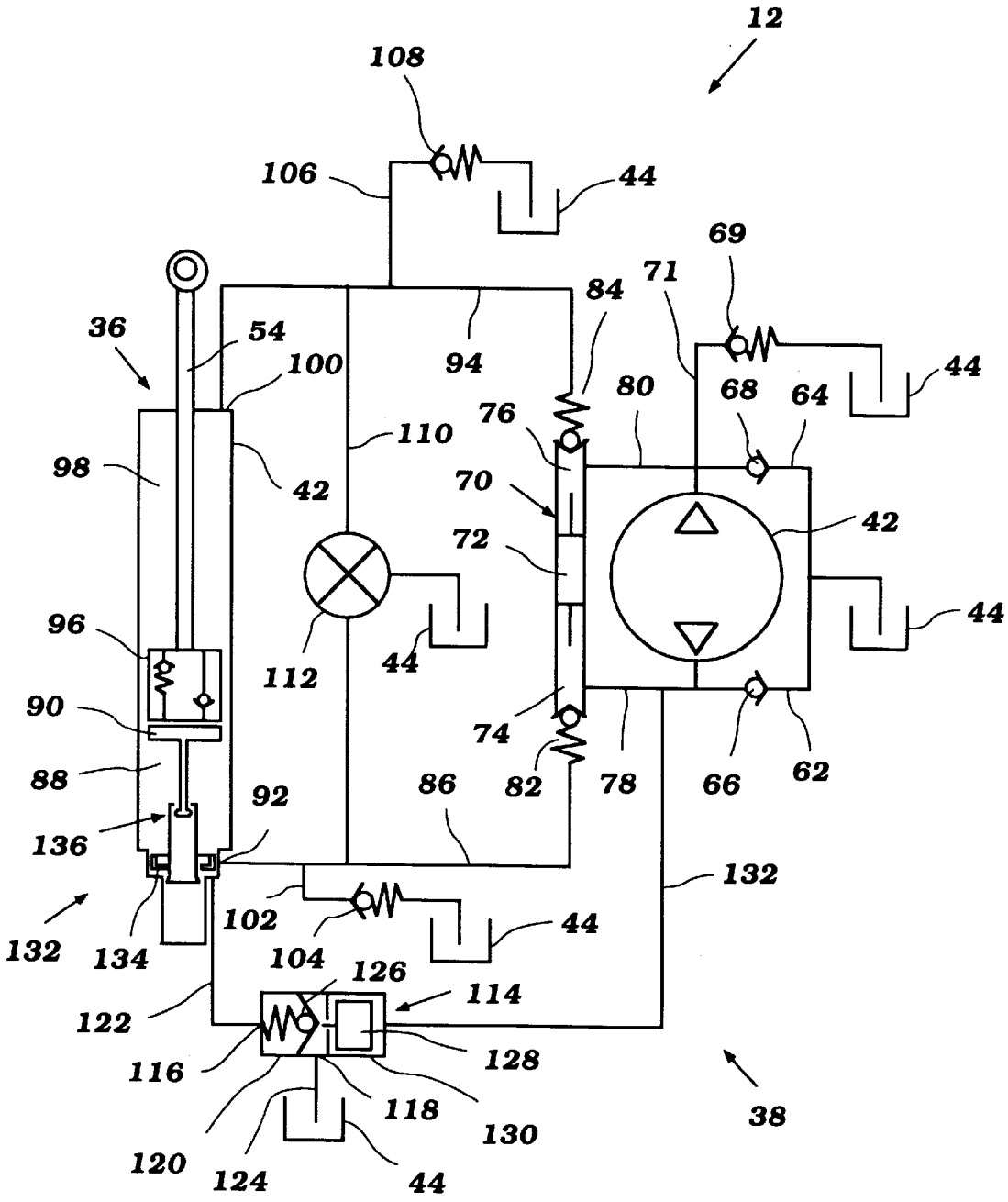
FIG. 3 is a schematic drawing of the hydraulic circuitry of the tilt and trim adjustment system of FIG. 2.

FIG. 3 schematically illustrates the hydraulic circuitry of the powering assembly 38 that powers and controls the hydraulic motor assembly 36. As mention above, the powering assembly 38 includes a reversible, positive displacement pump 42 that is driven by a reversible electric motor 40 (not shown). The pump 42 includes a pair of inlet lines 62, 64 that extend from the sump 44 and in which respective non-return check valves 66, 68 are provided. A pump relief valve 69 is provided in a line 71 that communicates the junction of the supply line 64 and a delivery line to prevent the occurrence of abnormally high pressure within the pump 42 or in the associated supply and delivery lines. The relief valve 69 opens into the sump 44.

A shuttle valve assembly, indicated generally by reference numeral 70, is provided downstream of the pump 42 and includes a shuttle piston 72 that divides the interior of the shuttle valve 70 into first and second chambers 74, 76. The pump 42 selectively delivers pressurized fluid to the first chamber 74 through a delivery line 78 and receives the working fluid from the first chamber 74 through this same line. In a like manner, the second chamber 76 communicates with the opposite side of the pump 42 through the another delivery line 39.

A first check valve 82 regulates flow through a port on the shuttle valve that communicates with the first chamber 74. In a similar manner, a second check valve 84 controls fluid flow to and from the chamber 76. The shuttle valve piston 72 has outwardly extending pin projections that are adapted to engage the balls of the check valves 82, 84 to open these check valves, as will become apparent.

A first pressure line 86 extends from the shuttle valve first chamber 74 to the lower side of a lower cylinder chamber 88 beneath lower piston 90 through cylinder port 92. A second pressure line 94 connects the shuttle valve second chamber 76 with the tilt actuator cylinder 46 on a side above an upper piston 96 and in communication with an upper cylinder chamber 98 through cylinder port 100.

A high pressure relief device is provided for both the upper and lower cylinder chambers 88, 98. A relief line 102 is connected to the first pressure line 86 at a point between the shuttle valve 70 and the lower cylinder port 92. A relief valve 104 is provided within the relief line 102. The relief valve is sized to open upon the occurrence of an abnormally high pressure and communicates directly with the sump 44 so as to release the working fluid from the cylinder lower chamber 88 and pressure line 86 to the sump 44. In this manner, the high pressure relief device relieves pressure within the lower branch of the hydraulic circuit.

Similarly, a second relief line 106 is connected to the second pressure line 94 at a point between the shuttle valve 70 and the upper cylinder port 100. A second relief valve 108 regulates fluid flow through the relief line 106. When the pressure in the line 106 is above a predetermined pressure, the valve 106 opens and allows the working fluid to pass into the sump 44.

The hydraulic circuit of the powering assembly 38 desirably has a bypass line 110 in order to provide manual tilt and trim adjustment. The bypass line 110 connects together the first and second pressure lines 86, 94. A manual override valve 112 normally prevents fluid communication through the bypass line 110; however, when the valve 112 is manually opened, the bypass line 110 places the upper and lower cylinder chambers 98, 88 in communication with each other and with the sump 44. The outboard motor 10 then can be raised or lowered manually.

A tilt relief valve 114 prevents trimming up the motor in the tilt range. The valve is operated by the pump and opens only when (i) the pump is on, and (ii) the pressure within the lower cylinder chamber 88 is greater than a pre-selected pressure that corresponds to a pressure just greater than that required to trim-up the motor to the fully trimmed-up position (TU) when under full throttle. The outboard motor therefore does not automatically trim down from a point within the tilt range B and can be run at medium or higher speed in a partially tilted-up position for shallow water operation. The pump-control valve, however, prevents further tilt-up in the tilt range B when run at higher speeds.

In the illustrated embodiment, the tilt relief valve 114 comprises a shuttle-type valve and includes an influent port 116 and an effluent port 118 that both communicate with a flow chamber 120. The influent port 116 is connected to a pressure relief line 122 that selectively communicates with the lower cylinder chamber 88. The effluent port is connected to a drainage line 124 that leads to the sump 44.

A normally closed check valve 126 operates within the flow chamber 120 to prevent fluid flow through the chamber 120 between the influent and effluent ports 116, 118. The check valve 126 is biased closed by a spring as well as by the pressure on its influent side.

The shuttle valve 114 also includes a shuttle piston 128 that slides within a pressure chamber 130 of the valve 114. The pressure chamber 130 communicates with the pump 42 via a pressure line 132. The pressure line 132 is connected to the first delivery line 78 at a point upstream of the main shuttle valve 70. The other end of the pressure line 132 is connected to a port of pressure chamber 130 on one side of the piston 128. The piston 128 includes an actuator pin that extends from an opposite side of the piston 128. Movement of the piston toward the check valve 126, under sufficient force provided by the pump, causes the actuator pin to engage the check valve ball and unseat it to open the valve 114. Working fluid can then drain to the sump 44 though the relief line 122 when the pressure within the lower cylinder chamber 88 exceeds the preselected pressure.

The effect of the tilt relief valve 114, however, is limited to movement within the tilt range B. The tilt relief valve 114 does not communicate with the lower cylinder chamber 88 when the tilt and trim mechanism 12 operates within the trim range A. A valve device 132 within the cylinder 42 regulates this selective communication.

Figure 4:
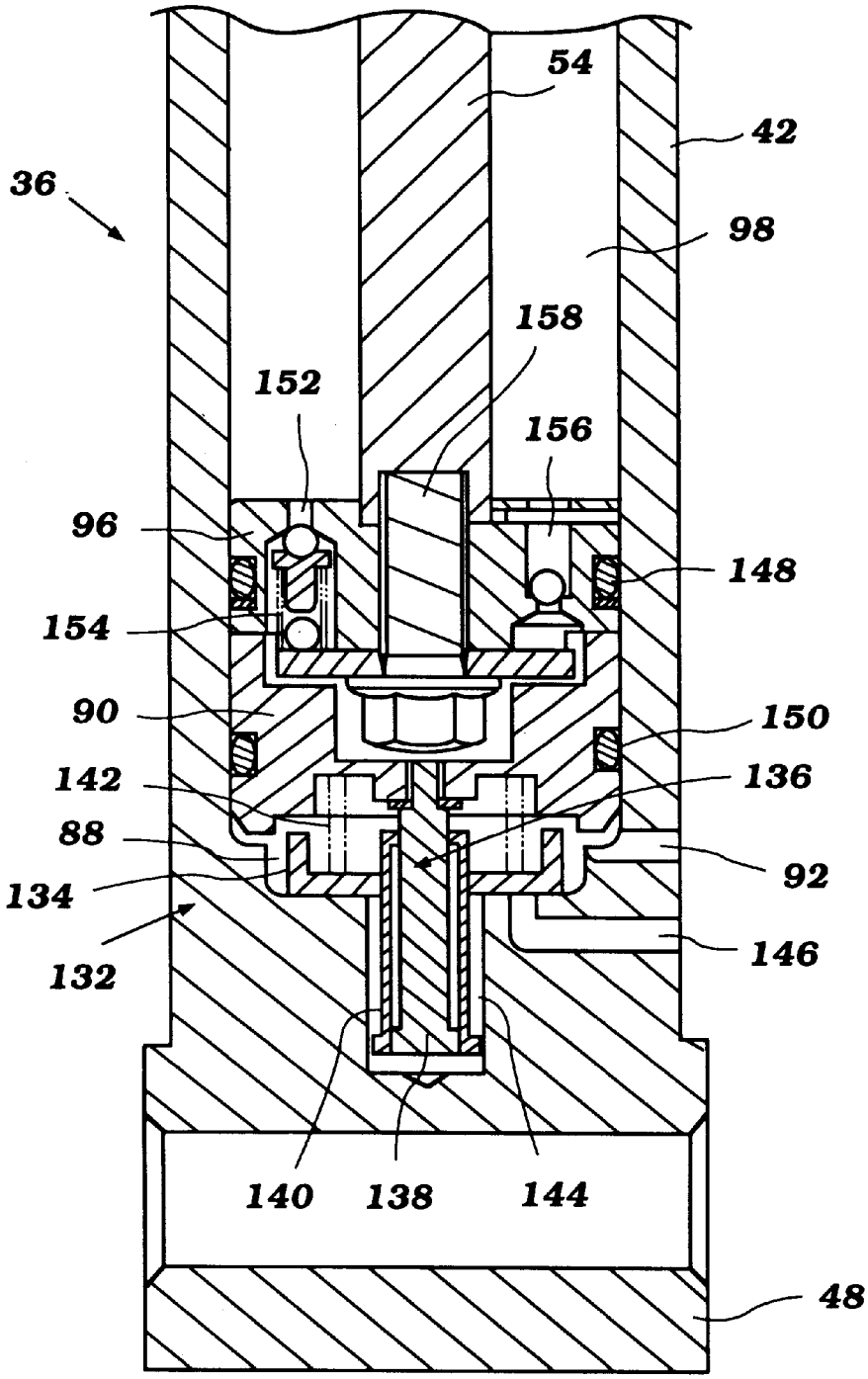
FIG. 4 is a partial cross-sectional view taken through an actuator cylinder of the tilt and trim adjustment system with the cylinder in a position corresponding to the fully trimmed-down position.
Figure 5:
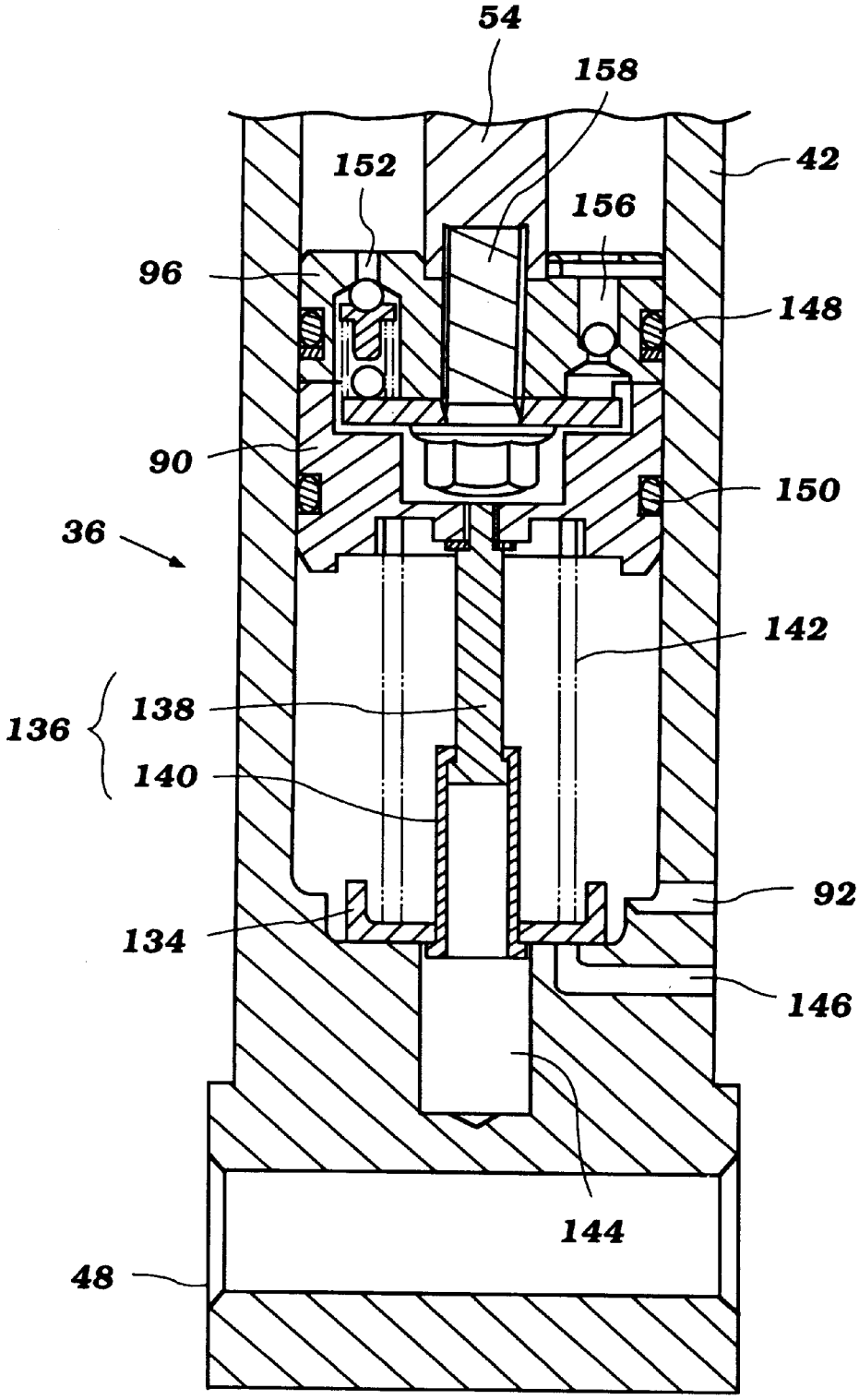
FIG. 5 is a partial cross-sectional view taken through the actuator cylinder, similar to FIG. 4, with the cylinder in a position corresponding to the fully trimmed-up position.

As best seen in FIGS. 4 and 5, the valve device 132 includes a valve gate 134 that is coupled to the lower piston by a lost motion connection. In the illustrated embodiment, the lost motion connection comprises a telescoping mechanism 136 that includes a central pin 138 and an outer sleeve 140. The central pin 138 is secured to the lower side of the lower piston 90. The outer sleeve 140 fits around the pin 138 and includes an upper end that is configured to engage the lower end of the central pin 138. For this purpose, the outer sleeve 140 includes a closed end with a through hole through which the central pin 138 extends. An inner abutment surface is formed about the through hole. The central pin 140 also includes a collar that circumscribes its lower end. When the piston 90 is moved to a position that extends this telescoping mechanism 136, the collar abuts the inner abutment surface so that the pin 138 and outer sleeve 140 move together with after upward movement.

The outer sleeve 140 also includes an outer collar that circumscribes the outer sleeve's lower end. The sleeve 140 is sized to extend through a through hole in the valve gate 134, but the collar is too large. The collar thus engages the lower side of the valve gate 134 when the telescoping mechanism 136 is fully extended.

A compression spring 142 desirably biases the valve gate 134 against the lower floor of the cylinder. For this purpose, the spring 142 operates between the valve gate 134 and the lower piston 90. And in the illustrated embodiment, the spring 142 is positioned about the telescoping mechanism 136. The lower piston 90 and the valve gate 134 are also configured to accommodate the compressed spring 142 when the piston 90 lies in a position that corresponds to the fully trimmed-down position TD (see FIG. 4).

The cylinder 42 includes a bore 144 positioned below the lower chamber 88. The bore 144 is sized to receive the telescoping mechanism 136 when the piston 90 lies in a position that corresponds to the fully trimmed-down position TD of the outboard motor 10.

The lower port 92 on the cylinder body 42 desirably lies at a lower side of the cylinder 42. In this position, the port 92 communicates with the lower chamber 88 at minimum volume as defined between the lower piston 92, the floor of the cylinder 42 and the valve gate 134. The port 92 may also have a slight upward orientation so as to direct working fluid toward the piston 90.

The cylinder 42 also includes a relief port 146 formed on the cylinder's floor. The relief port 146 is connected to the relief line 122 that leads to the tilt relief valve 114. As explained in greater detail below, the valve gate 134 covers the relief port 146 when the tilt and trim mechanism 12 resides in the trim range A, and opens the relief port 146 when the tilt and trim mechanism 12 resides in the tilt range B.

Both the upper piston 96 and the lower piston 90 are fitted with O-rings 148, 150, respectively. The O-rings 148, 150 provide a seal between the upper piston 96 and the internal bore of the cylinder housing 42 and between the lower piston 90 of the same housing 42.

In addition to actuating the motor 10 within the tilt and trim ranges A, B, the motor assembly 36 of the tilt and trim mechanism 12 provide hydraulic damping. The damping or shock-absorbing operation allows the motor 10 to pop-up if it strikes an underwater object so as to prevent damage. This feature is achieved by providing a passage 152 in the upper piston 98 for permitting flow from the upper chamber 98, above the upper piston 96, to a region between the pistons 90, 96. The passage includes the pressure responsive absorber valve 154 of the check valve type that permits flow in response to a predetermined force tending to cause the motor 10 to tilt or pop-up. The amount of the force necessary to open the valve 154 is set, as is well known, to the desired value. Return flow from the region below the upper piston 96 to the upper chamber 98 is permitted by opening a return passage of 156. A fastener 158 holds the upper piston and the valve 154 onto the lower end of the actuator arm 54. During the pop-up operation of the motor 10 the lower piston 90 remains stationary. By remaining in one place, the lower piston 90 serves as a memory device for the tilt and trim mechanism 12 so that the upper piston 96 can return to the same trim setting as before it struck the underwater object.

Figures 6A, 6B, 6C:
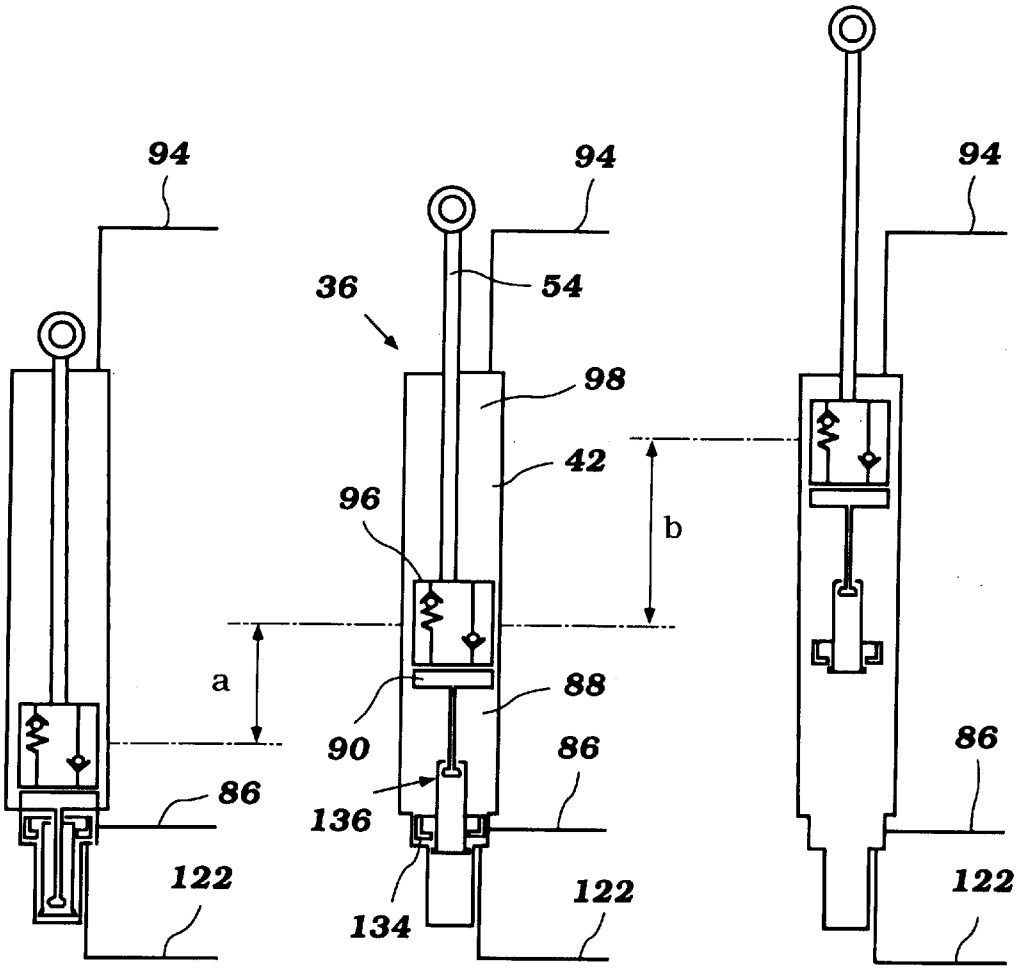
FIGS. 6A, 6B and 6C are schematic illustrations of the tilt and trim cylinder and associated fluid lines of the hydraulic circuitry of FIG. 3, and illustrate the cylinder in positions corresponding to the fully trimmed-down position, the fully-trimmed-up position, and the full tilt position, respectively.

FIGS. 6A and 6B schematically illustrate the condition of the motor assembly 36 of the tilt and trim mechanism 12 during the full trim down and full trim up modes, respectively. FIG. 6C schematically illustrates the motor assembly 36 in the tilt region. Assuming that the outboard motor is positioned in the trim range A and that the manual valve 112 is closed, if the operator desires to provide a trim up adjustment, through a suitable control, he operates the motor 40 to drive the pump 42 in a direction that will pressurized the delivery line 78 while the other delivery line 80 acts as a return line (in FIG. 3). When the delivery line 78 is pressurized, the pressure in the lower chamber 74 of the shuttle valve 70 will exceed the pressure in the upper chamber 76 and the shuttle piston 72 of the shuttle valve assembly 70 will be forced toward the check valve 84 from its previously neutral position. That is, when the shuttle piston 35 is shifted toward the upper check valve 84, the projection on the shuttle piston 72 contacts and unseats the ball of the check valve 94, and opens communication between the upper shuttle valve chamber 76 and the pressure line 94.

Pressurization of the chamber 74 causes the lower ball check valve 82 to open. The pump forces fluid into and builds pressure within the lower cylinder chamber 88. The fluid passes through the lower pressure line 86 in doing so.

The increasing pressure within the lower cylinder chamber 88 forces the lower piston 90 and the upper piston 96 toward the upper end of cylinder 42. As best understood from FIGS. 4, 5 and 6*b*, the central pin 138 of the telescoping mechanism 136 moves with the lower piston 90 until the shoulder on the end of central pin 138 contacts the inner ledge of outer sleeve 140. At this time, the lower piston 90 pulls both the central pin 138 and the outer sleeve 140 until the shoulder of outer sleeve 140 contacts valve gate 134. During this entire process the coil spring is forcing the valve gate 134 downward to seal the relief port 146. A position of the pistons 90, 96 and the telescoping mechanism 136 in a position that corresponds to the fully trimmed-up position TU of the outboard motor 10 is shown in FIG. 5.

The lower piston 90 is thereby caused to move in an upward direction toward the upper end of the cylinder 42. The force created by the upward movement of the lower piston 90 is also imparted to the upper piston 96, as the two pistons are in contact along their adjacent faces during this operation. Accordingly, the motor 10 is trimmed up by way of the piston rod 54. As the upper piston 96 moves upward, in conjunction with the lower piston 90, the hydraulic fluid in the upper cylinder chamber 96 is discharged through the upper port 100 and into the upper pressurization line 94 for return to the input side of the pump 42 through the shuttle piston chambers 76 and the return line 80.

To tilt up the motor 10 into and through the tilt range B (FIG. 1), the pump 42 and shuttle valve 70 operate in the manner described above. The pressurized hydraulic fluid flows through the lower pressure line 86 and into the lower cylinder chamber 88. This consequently forces further upward the lower piston 90 and the upper piston 96. Accordingly, the upper piston 96 and the piston rod 54 are moved toward the upper end of the cylinder 42.

During the tilt up operation, the working fluid in the upper cylinder chamber 98 exits the chamber through the upper port 100 into the upper pressure line 94 and back through the shuttle valve 70 and into the pump 42. If the pressure is abnormally high and is above a predetermined amount, the fluid can also be released to the sump 44 through the check valve 108.

The beginning of the tilt range B is marked by the complete extension of the telescoping mechanism 136 and the unseating of the valve gate 134 from the relief port 146. The stroke "a" in FIG. 6 corresponds to the trim range A (FIG. 1). The end of the tilt range B is marked by the opening of the tilt relief valve 114. The stroke "b" in FIG. 6 corresponds to the tilt range.

For instance, when tilting up the motor either while not under power or while traveling at low or medium speeds, the tilt relief valve 114 remains closed, and the motor can be tilted up until the completion of the actuator rod's stroke. At this point, the force produced by the shuttle 128 of the tilt relief valve 114, which is driven by the pump 42, is greater than the opposing force on the check valve 126 produced by the spring and the pressure on the influent side of the valve 114. Although the pressure of the working fluid in the pressurization chamber 130 and in the flow chamber 120 of the valve 114 will be generally the same, the comparatively small contact area of the shuttle's projection produces a greater force in the direction that opens the valve. Additional pressure can not build within the lower cylinder chamber 88 with the relief valve 114 open. Working fluid passes through, rather than accumulates within, the chamber 88, and drains through the relief and drainage lines 122, 124 to the sump 44. At this point, the operator should then discontinue operation of the pump 42. The shuttle valves 70, 114 close with the pump off, and the hydraulic fluid contained within the lower cylinder chamber 44 supports the outboard motor 10 in the fully tilted-up position FU.

The present hydraulic circuitry of the powering assembly 38 prevents further tilt up when the outboard motor 10 is propelling the watercraft at high speeds under a larger thrust. In this case, the high speed pressure relief valve 114 opens well before fall tilt-up FU. The valve is specifically designed to open when the pump is operated and a relative large pressure builds in the lower cylinder chamber 88, due in part by the increased thrust. Further upward movement of the piston 90 is not possible with the valve 114 open. Working fluid passes through, rather than accumulates within, the chamber 88, and drains through the relief and drainage lines 122, 124 to the sump 44. In addition, the relief port 146 can be configured and sized such that an additional amount of working fluid may also drain from the lower cylinder chamber 88 in order to automatically trim down the outboard motor 10 from the point within the trim range B to the fully trimmed up position TU when operating at high speeds. At the fully trimmed up position, the valve gate 134 closes the relief port 146 and further fluid cannot drain from the cylinder through the valve 114. Once the motor is turned off, or the thrust produced by the outboard motor is decreased, the valve 114 closes and the hydraulic fluid contained within the lower cylinder chamber 44 supports the outboard motor 10 in the set position.

The tilt and trim down operation will now be described by reference to FIG. 3. Assuming that the motor 10 is in a tilted up condition (i.e., within the tilt range B), the upper pistons 96, 90 will be near the upper end of the bore of the cylinder 42. If the operator decides to tilt the motor down, the electric motor 40 is energized so as to drive the pump 42 in a direction that pressurizes the delivery line 80 and causes the other delivery line 78 to function as a pump return line. The pressure in the upper delivery line 80 will also be created by the weight of the motor 10 during the tilt down operation and by any thrust produced by the outboard motor 10 during the tilt down operation.

When the line 80 is pressurized, the pressure in the chamber 76 of the shuttle valve assembly 70 will shift the shuttle valve toward the line 78 thereby unseating the check valve 82. The pressure in the chamber 76 is also sufficient to unseat the check valve 84 thus allowing fluid to flow from the chamber 76 and thereby pressurizing the line 94. Accordingly, pressure will be exerted in the upper cylinder chamber 98 above the piston 96. The piston 96 will be forced downward toward a lower end of the cylinder 42 to tilt down the motor 10. During downward movement of the upper and lower pistons 96, 90 a quantity of fluid is expelled from within the lower cylinder chamber 88 through the port 92 to the line 86 and passes through the opened valve 82 into the chamber 74 and to the pump return line 78. When the desired position is reached, the operator again stops the motor and the propulsion unit 10 will be retained in the desired position by the lockage of hydraulic fluid in the cylinder chambers.

Fluid may also be expelled from the lower cylinder chamber 88 through the relief port 146 during the tilt down operation. If the pump 42 is operating and if the pressure within the chamber 88 is above a pre-selected amount, the valve 114 will open to relief pressure from the chamber 88. This typically occurs when trimming down the motor from a point within the tilt range B and traveling at high speeds.

The end of the fully tilted down position is marked by the valve gate 134 covering relief port 146. When the valve gate 134 completely covers relief port 146, the motor 10 is in the fully trimmed-up position TU. To trim propulsion unit 10 down the hydraulic fluid is delivered to the upper cylinder chamber 98 (as discussed above with reference to the tilt down operation), and the hydraulic fluid in the lower cylinder chamber 88 is discharged through the line 86.

If the motor continues to run in the trim down condition once both pistons have reached the limits of their travel, the pressure in the line 94 will rise abruptly and the relief valve 108 will open causing fluid pressurized by the pump 42 to be returned to the sump 44.

In the fully trimmed-down position shown in FIG. 4, the telescoping mechanism 136 is in a fully collapsed position. The upper cylinder chamber 47 is pressurized with fluid thereby moving both the pistons 96, 90 toward the lower end of the cylinder 42. The lower piston 90 acts on the coil spring 142 thereby placing a downward force on the valve gate 134 and sealing the port 146. In this position the central pin 138 of the telescoping mechanism 136 is at the end of its stroke within the outer sleeve 140 and both are located in the cylinder bore 144.

If at any time it is desired to manually tilt the motor 10 up, the manually operated valve 112 may be opened to open communication between the cylinder chambers 88, 98 through the line 110. When the valve 112 is opened, an upward force on the motor 10 will cause the piston rod 54 to move upwardly and displace fluid through the line 110 to the lower chamber 88. Closure of the valve 112 will then lock the motor 10 in its up position. In a like manner, opening of the valve 112 can permit the motor 10 again to be lowered manually under its own weight which will effectively displace fluid from the lower cylinder chamber 88 through the line 110 and into the upper cylinder chamber 98. Make up fluid can be obtained from, or excess fluid delivered to, the sump 44 with regard to any of the cylinder chamber regions as necessary during either of these operations.

The present tilt and trim adjustment system 12 offers the advantage of providing trim control of the outboard motor up into the tilt range when running at low or medium speeds, but not at high speeds. This and other advantages will become more apparent from a brief discussion of other tilt and trim adjustment systems.

Figure 7:
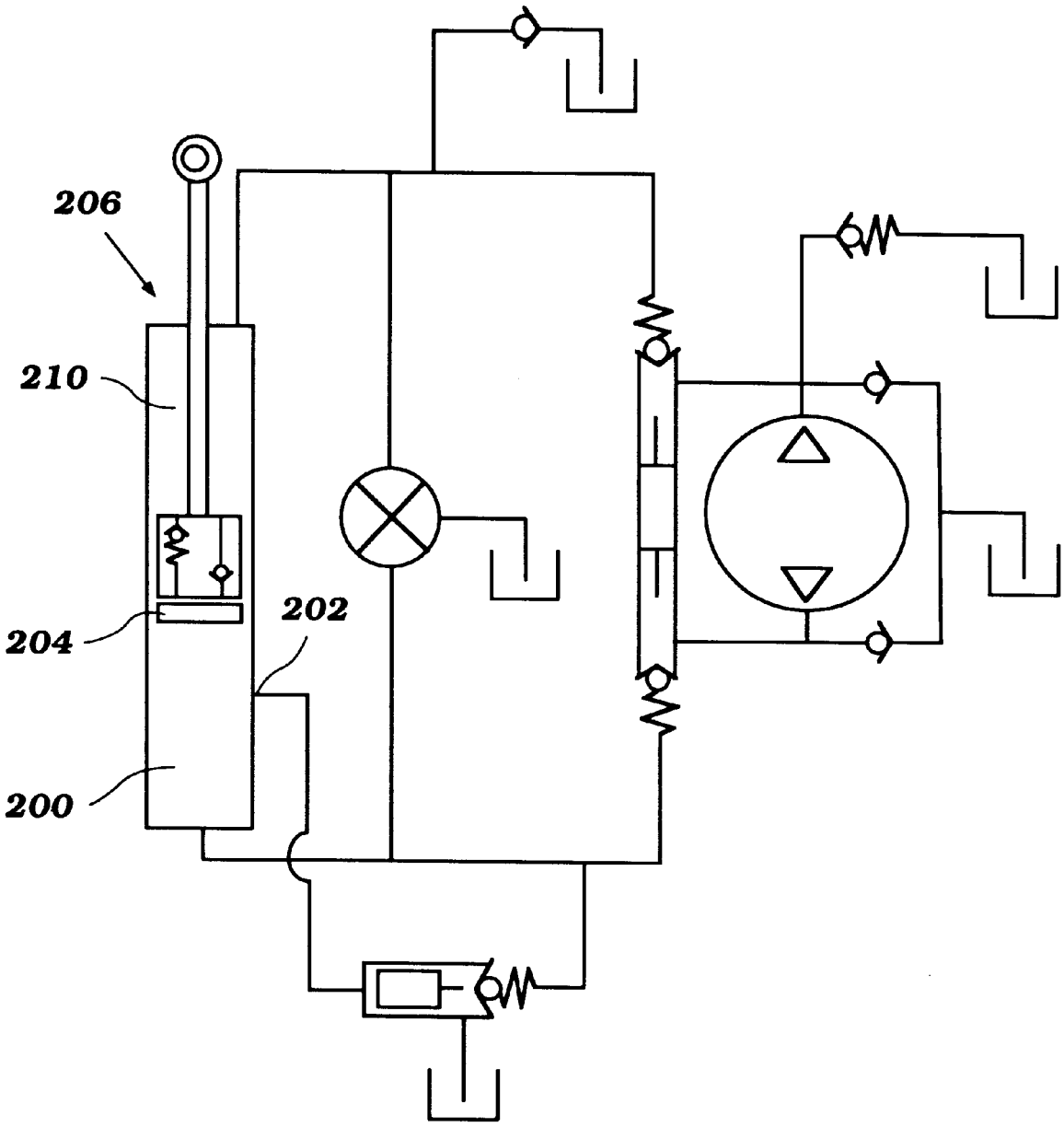
FIGS. 7 and 8 are schematic illustrations of other hydraulic circuit designs.

With reference to FIG. 7, a hydraulic circuit includes a different type of relief mechanism connected to the lower cylinder chamber 200. In this design shown in FIG. 7, fluid would leave the lower cylinder chamber 200 through the relief port 202 when the lower piston 204 was not in a position to block the entrance to the port 202. The location of the port 202 on the side chamber wall of the cylinder 206 was located to correspond to the tilt range of outboard motor. Thus, when the outboard motor is in the tilt range the position of lower piston 204 allows passage of fluid into the port 202 relieving the lower cylinder chamber of the pressure generated in the trim mode. If the outboard motor is trimmed down, the piston 204 moves toward the lower end of cylinder 206. In the fully trimmed-down position, the piston seals must travel over the port 202.

The piston seal is typically an O-ring made of a rubber material as is generally known in the art. The O-ring gradually wears down with repeated contact between the piston seal and the relief port 202. After continued use, the piston seal often becomes damaged and the seal will lose its integrity allowing fluid to pass around the seal and into the upper cylinder chamber 210. In contract, the piston seals 148, 150 never contact the relief port 146 of the present tilt and trim adjustment system 12, thereby increasing the durability of the design.

Figure 8:
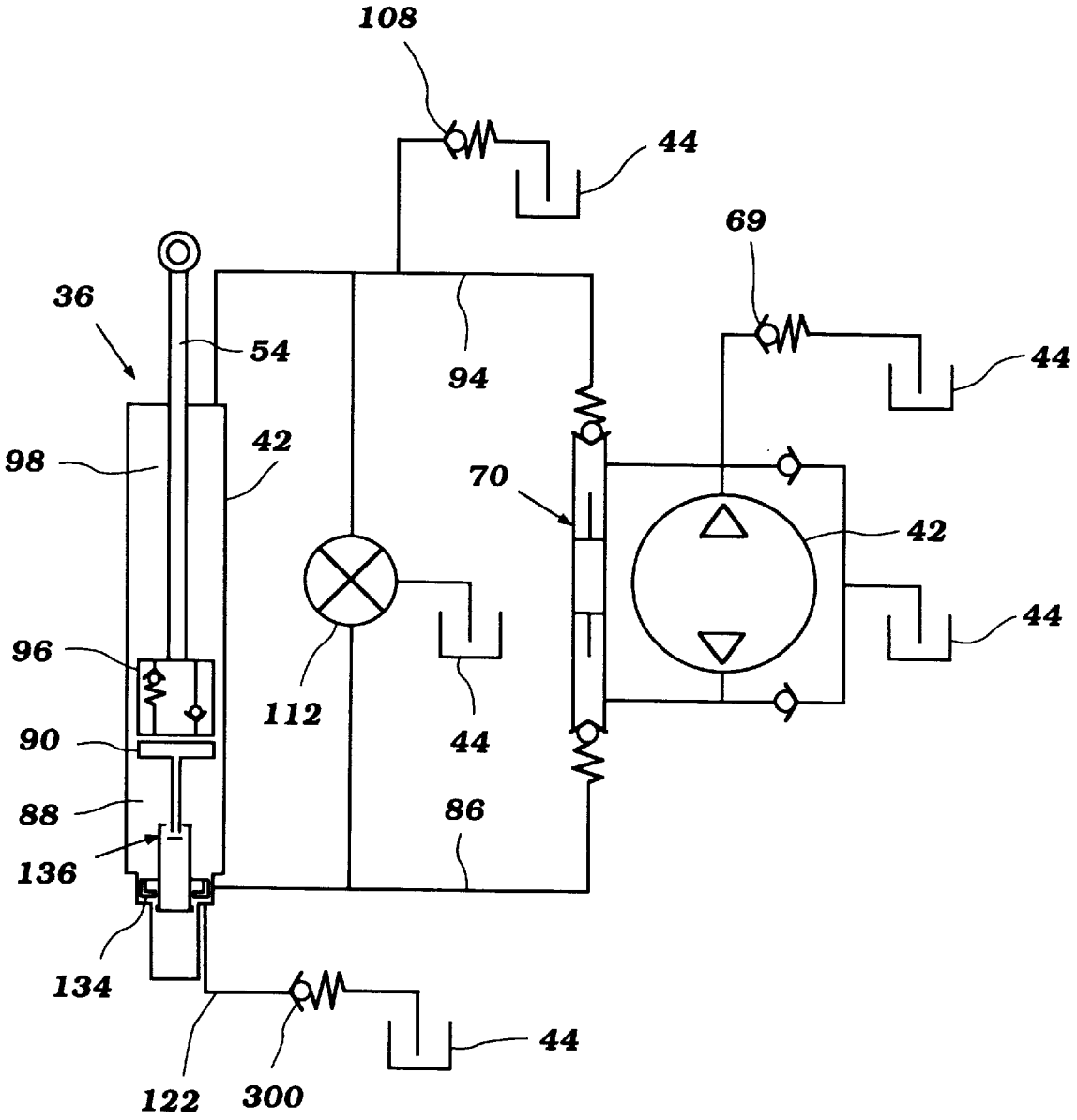

The hydraulic circuit illustrated in FIG. 8 includes an arrangement of the pressure relief port similar to that illustrated in FIGS. 3–6. The system illustrated in FIG. 8 is the subject of co-pending application Ser. No. 08/867,172, filed Jun. 2, 1997, entitled "Hydraulic Tilt and Trim Control For Marine Propulsion", filed in the name of Daisuke Nakamura, and assigned to the assignee hereof, which is hereby incorporated by reference. Except for the arrangement of the pressure relief valves associated with the lower cylinder chamber, the hydraulic circuits illustrated in FIG. 3 and FIG. 8 identical. Accordingly, the same reference numerals have been used to indicate like components between the two systems.

The hydraulic circuit illustrated in FIG. 8 uses a ball-type check valve 300 to regulate fluid flow through the relief line 122. A spring biases the valve 300 normally closed. The pressure within the lower cylinder chamber 88 works against the spring and causes the valve to open when the pressure reaches a pre-selected level. The valve 300 is sized and selected to open at pressures above the pre-selected level.

Figure 9:
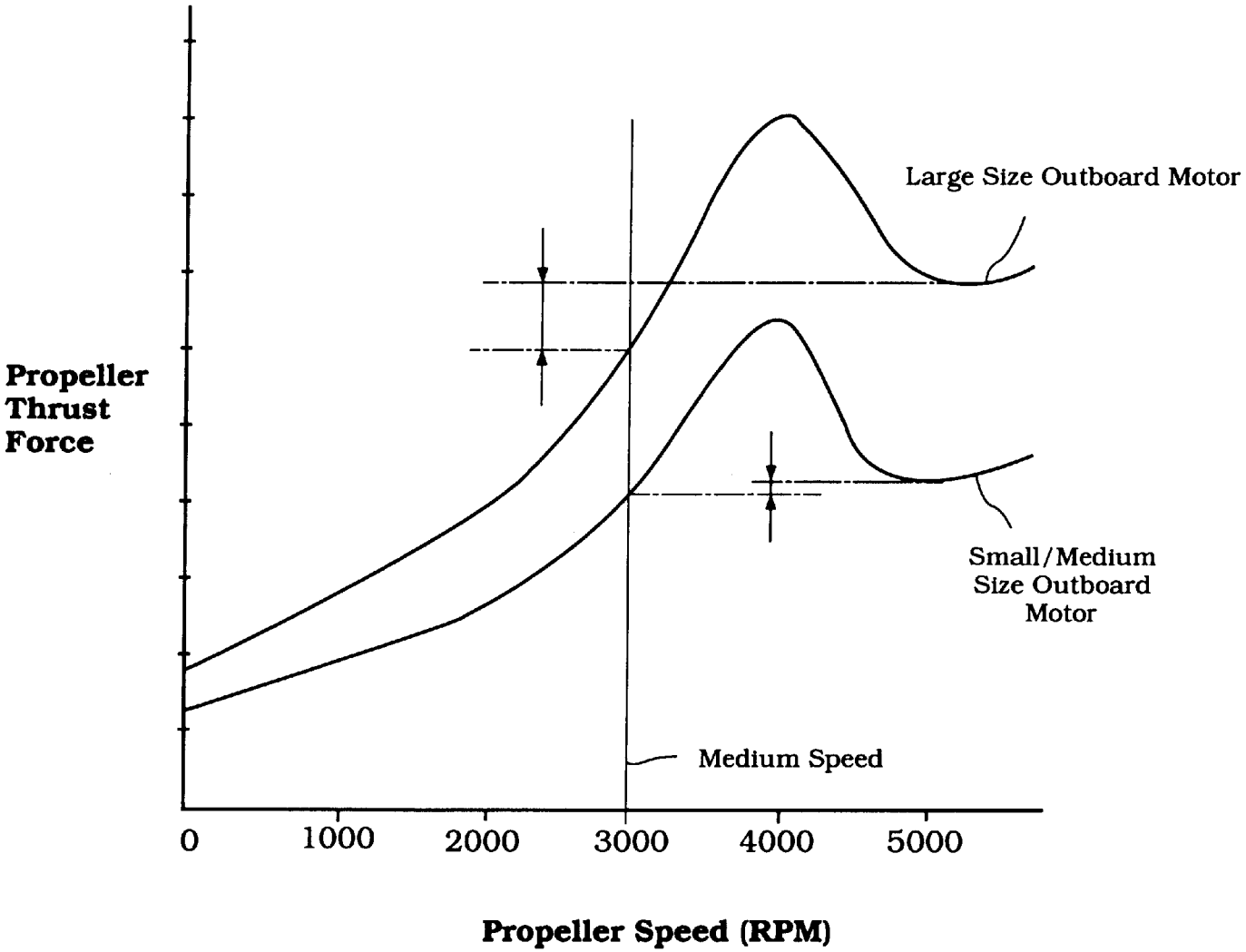
FIG. 9 is a graph of thrust curves plotted against engine speed for an exemplary large outboard motor and for an exemplary smaller outboard motor.

While this type of valve functions acceptably for larger sized outboard motors (e.g., 200 hp), the system does not work as well with smaller sized outboard motors (e.g., 90 hp). With reference to FIG. 9, the thrusts produced at high speed (expressed as propeller rpm) and at a medium speed (e.g., 3000 rpm) differ greatly for a large size outboard motor. The pressure at which the valve 300 opens is set at a level that corresponds to thrust product at full throttle. Thus, at medium speed, the valve 300 remains closed and the outboard motor can be trimmed up into the tilt range.

For smaller outboard motors though, only a slight difference exists between the thrusts produced by the smaller motor at high and medium speeds. The check valve, which commonly has only coarse precision, often times opens the valve 300 at medium speeds to prevent trim up of the outboard motor into the tilt range at such speeds. Thus, the associated tilt and trim adjustment system cannot be used to adjust and hold the small outboard motor to run in shallow water conditions.

In the present system, however, the high speed pressure relief valve cannot not open without operation of the motor. The motor remains in place once set. In addition, the shuttle-type valve used as the pressure relief valve is significantly more precise than a conventional check valve. A greater ab:ty to differentiate between pressure values can be achieved to only open the valve once the high speed condition is reached, and not before. Thus, by linking the pump and the valve together, and in the process using a more precise valve, the outboard motor cannot be unintentionally trimmed down from a position within the tilt range when running at low and medium speeds. Two conditions must be met in order for the relief valve to open: (1) the pump must be on; and (2) a high pressure level must exist within the lower cylinder chamber, such as that which occurs when running the outboard motor at high speeds.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A hydraulic tilt and trim adjustment system for a marine drive that runs through a range of speeds including low and medium speed and high speeds, the tilt and trim adjustment system comprising an actuator having a stroke length and at least one chamber, a portion of the stroke length corresponding to a trim range of the marine drive and the balance of the stroke length corresponding to a tilt range, a pump being connected to the chamber by a pressure line to selectively supply a working fluid to chamber of the actuator, a reservoir tank communicating with the pump, a passage connecting the cylinder chamber to the reservoir tank, and a tilt relief valve positioned within the passage and arrange to control flow through the passage, said tilt relief valve being open when said pump is active, a pre-selected pressure occurs within the chamber, and the actuator is operating within the tilt range, and closed when the pump is inactive, the pressure within the chamber is below a pre-selected pressure, and the actuator is operating within the tilt range so as to maintain the tilt position of the marine drive when running at slow and medium speeds.

2. A hydraulic tilt and trim adjustment system as in claim 1, wherein said tilt relief valve is a shuttle-type valve.

3. A hydraulic tilt and trim adjustment system as in claim 2, wherein said shuttle-type valve includes a pressure chamber in which a shuttle piston slides, and the pump is connected to the pressure chamber.

4. A hydraulic tilt and trim adjustment system as in claim 1, wherein said chamber of said actuator is a lower chamber, and the tilt relief valve is open only when the pump supplies pressurized fluid to the lower chamber.

5. A hydraulic tilt and trim adjustment system as in claim 1, wherein the actuator comprises cylinder, a piston fixed to an end of an actuator arm and arranged to slide within the cylinder, and the lower chamber is defined within the cylinder below the piston and has a variable volume as the piston slides within the cylinder.

6. A hydraulic tilt and trim adjustment system as in claim 1 additionally comprising a delivery line that extends between the actuator chamber and the pump, and a relief valve positioned within either the delivery line or the passage, both of which communicate with the actuator chamber, so as to deal with abnormally high pressure generated within the actuator chamber.

7. A hydraulic tilt and trim adjustment system for a marine drive comprising an actuator having a stroke length and at least one chamber, a portion of the stroke length corresponding to a trim range of the marine drive and the balance of the stroke length corresponding to a tilt range, a plump selectively supplying a working fluid to the chamber of the actuator, a reservoir tank communicating with the pump, a passage extending between the cylinder chamber and the reservoir tank, and a tilt relief valve positioned within the passage, the tilt relief valve being arranged such that the pressure within the actuator chamber biases the tilt relief valve closed.

8. A hydraulic tilt and trim adjustment system for a marine drive comprising an actuator having at least one fluid chamber, a relief port communicating with the chamber, a pump selectively supplying a working fluid to the chamber through a delivery line, and a relief valve connected to the relief port to selectively permit fluid flow through the relief port, said valve communicating with the pump through the delivery line and additionally being linked to the pump, in a manner independent of the delivery line, so as to be opened when the pump is activated.

9. A hydraulic tilt and trim adjustment system as in claim 8, wherein the valve includes a fluidic operator which is connected to the pump.

10. A hydraulic tilt and trim adjustment system as in claim 9, wherein the valve is a shuttle type valve with piston-type fluidic operator.

11. A hydraulic tilt and trim adjustment system as in claim 8, wherein the relief valve is arranged such that the pressure within the actuator chamber biases the valve closed.

12. A hydraulic tilt and trim adjustment system as in claim 8, wherein the actuator moves within a first stroke range that corresponds to a trim range of the marine drive, and within a second stroke range that corresponds to tilt range of the marine drive.

13. A hydraulic tilt and trim adjustment system as in claim 8 additionally comprising a valve operating between the actuator chamber and the relief valve which opens only when the actuator is within the second stroke range.

14. A hydraulic tilt and trim adjustment system as in claim 8 additionally comprising a delivery line that extends between the actuator chamber and the pump, and a relief valve positioned within either the delivery line or the passage, both of which communicate with the actuator chamber.

15. A method of operating a tilt and trim adjustment system which moves a marine drive between a fully trimmed-down position and a fully trimmed up position through a trim range, and between the fully trimmed-up position and a full-up position through a tilt range, said tilt and trim actuator mechanism including an actuator powered by a pump and a tilt release valve connected to the actuator, said actuator moving within a trim stroke range, that corresponds to the trim range of the marine drive, and a tilt stroke range, that corresponds to the tilt range, said method comprising maintaining closure of the tilt relief valve when the marine drive is operating at low and medium speeds and the actuator is within tilt stroke range, and opening the tilt relief valve only when a pre-selected pressure is applied to an inlet of the tilt relief valve, the associated pump is activated, and the actuator is within the tilt stroke range.

16. A method as in claim 15 additionally involving closing an inlet to the tilt relief valve when the actuator is within the trim stroke range.

17. A method as in claim 15, wherein the pre-selected pressure is chosen to correspond to a pressure produced within the actuator when the marine drive operates at high speed.

* * * * *